US006586716B1

(12) United States Patent
Lee

(10) Patent No.: US 6,586,716 B1
(45) Date of Patent: Jul. 1, 2003

(54) WALL-MOUNTED TYPE MICROWAVE OVEN

(75) Inventor: Chea-How Lee, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/289,064

(22) Filed: Nov. 7, 2002

(30) Foreign Application Priority Data

Jun. 29, 2002 (KR) ..... 2002-37605

(51) Int. Cl.[7] ..... H05B 6/80; F24C 15/20

(52) U.S. Cl. ..... 219/757; 219/756; 126/273 A; 126/299 R; 126/299 D; 15/314

(58) Field of Search ..... 219/757, 756, 219/681, 400; 126/21 A, 299 R, 299 D, 299 F, 273 A, 275 E, 198; 15/314, 315

(56) References Cited

U.S. PATENT DOCUMENTS 5,191,673 A * 3/1993 Damizet ..... 15/314
5,718,219 A * 2/1998 Boudreault ..... 126/299 R
6,239,419 B1 * 5/2001 Kim ..... 219/757

FOREIGN PATENT DOCUMENTS

JP 63-198237 2/1990

* cited by examiner

*Primary Examiner*—Philip H. Leung

(57) ABSTRACT

A wall-mounted type microwave oven which carries out a sweeping operation of kitchen areas positioned therebelow, as well as cooking and exhaustion operations. The microwave oven includes an oven body for mounting in a kitchen area, having a cooking chamber and an electrical component compartment which are isolated from each other, an exhaust flow path which communicates between an intake port provided at a bottom panel of the oven body and an exhaust outlet provided at a top panel of the oven body to exhaust air existing under the oven body to the outside, an exhaust fan assembly provided at the exhaust outlet, a sweeping inlet provided at the bottom panel of the oven body, a sweeping flow path which is disposed in the oven body and communicates with an inlet of the exhaust fan assembly and the sweeping inlet, a filter assembly disposed in the sweeping flow path, and a sweeping hose detachably coupled to the sweeping inlet.

20 Claims, 6 Drawing Sheets

WALL-MOUNTED TYPE MICROWAVE OVEN

CROSS-REFERENCE TO RELATED APPLICATIONS

This application claims the benefit of Korean Patent Application No. 2002-37605 filed on Jun. 29, 2002, in the Korean Intellectual Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven having a sweeping device to clean kitchen appliances disposed at positions adjacent thereto.

2. Description of the Related Art

Generally, a wall-mounted type microwave oven is mounted above an oven range on a wall of a kitchen space, and carries out a cooking operation, as well as an exhausting operation to exhaust gas and fumes generated from the oven range disposed therebelow. The oven range, such as a gas oven range, is normally equipped with a plurality of top-burners, each having a support grid to support a cooking pot placed thereon. The gas and fumes generated by the oven range are exhausted by the exhausting operation of the microwave oven disposed thereabove.

With use, the oven range is gradually polluted on its upper surface with scraps of food debris and condiments which are accidentally spilt by a user, and with dust floating in the kitchen space. As such, the oven range must be accasionally cleaned by a user.

However, since additional cleaning tools are required to clean the upper surface of the oven range, a cleaning operation of the oven range is considerably cumbersome. In particular, since structures of the top burners of the oven range are complicated, due to for example, the support grids that support cooking pots, it is difficult to clean the oven range where scraps of food debris and dust are accumulated on the top burners.

SUMMARY OF THE INVENTION

Accordingly, it is an object of the present invention to provide a wall-mounted type microwave oven which not only carries out exhausting and cooking operations, but also cleans an upper surface of an oven range and kitchen areas adjacent to the microwave oven via a suction force of an exhaust fan.

Additional objects and advantages of the invention will be set forth in part in the description which follows and, in part, will be obvious from the description, or may be learned by practice of the invention.

To achieve the above and other objects of the present invention, there is provided a wall-mounted type microwave oven comprising an oven body to mount in a cooking area and includes a cooking chamber and an electrical component compartment which are isolated from each other, an exhaust flow path which communicates between an intake port provided at a bottom panel of the oven body and an exhaust outlet provided at a top panel of the oven body to exhaust air, existing under the oven body, to the outside of the cooking area, an exhaust fan assembly provided at the exhaust outlet, a sweeping inlet provided at the bottom panel of the oven body, a sweeping flow path which is disposed in the oven body and communicates with an inlet of the exhaust fan assembly and the sweeping inlet, a filter assembly disposed in the sweeping flow path, and a sweeping hose detachably coupled to the sweeping inlet.

The sweeping flow path may be defined by a plurality of guide plates positioned at upper, side and lower portions of the oven body which isolate the sweeping flow path from the exhaust flow path.

Any one of the guide plates defining the sweeping flow path may include a communicating hole which allows the exhaust flow path to communicate with the sweeping flow path, and an opening-closing unit may be provided to selectively open and close the communicating hole.

The opening-closing unit may comprise an opening-closing plate rotatably provided adjacent to the communicating hole, a rotating link which is connected to a rotating shaft of the opening-closing plate and has a predetermined length, and a solenoid-driven device which includes an actuating rod connected to an end of the rotating link and linearly drives the rotating link to open/close the communicating hole.

The filter assembly may comprise a cover plate which is detachably fitted into a filter opening formed at a position of the bottom panel corresponding to the sweeping flow path, and a filter unit which is attached to an inner surface of the cover plate, has a sectional area corresponding to that of the sweeping flow path and filters out foreign substances contained in air introduced into the sweeping flow path.

The cover plate may include snap hooks which are provided at corresponding sides of the cover plate and elastically deform to allow the cover plate to be detachably fitted into the filter opening.

The sweeping inlet may include a locking recess, and the sweeping hose may include a corresponding locking protrusion which is provided at a coupling end of the sweeping hose and engages with the locking recess to secure the sweeping hose to the sweeping inlet.

The exhaust fan assembly may comprise a first exhaust fan which exhausts air introduced into the exhaust flow path, a second exhaust fan which exhausts air introduced into the sweeping flow path, and a motor which rotates the first and second exhaust fans concurrently.

The exhaust flow path may comprise a lower path section which is disposed at the bottoms of the cooking chamber and the electric component compartment and includes the intake port, a first rising path section which is vertically disposed behind the electric component compartment and communicates with the lower path section, and a second rising path section which is vertically disposed on a side wall of the cooking chamber and communicates with the lower path section.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
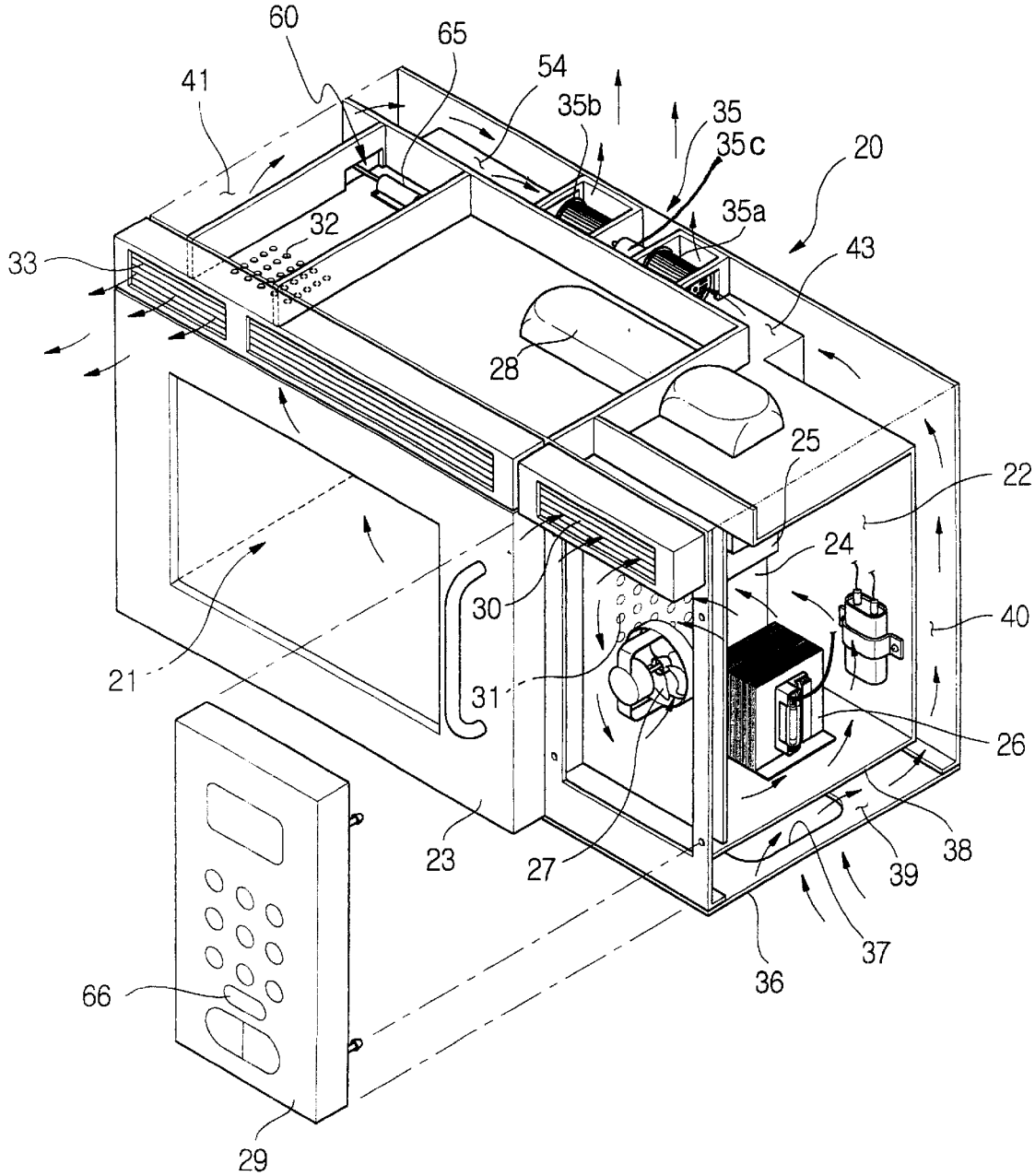
FIG. 1 is a perspective view of a wall-mounted type microwave oven according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
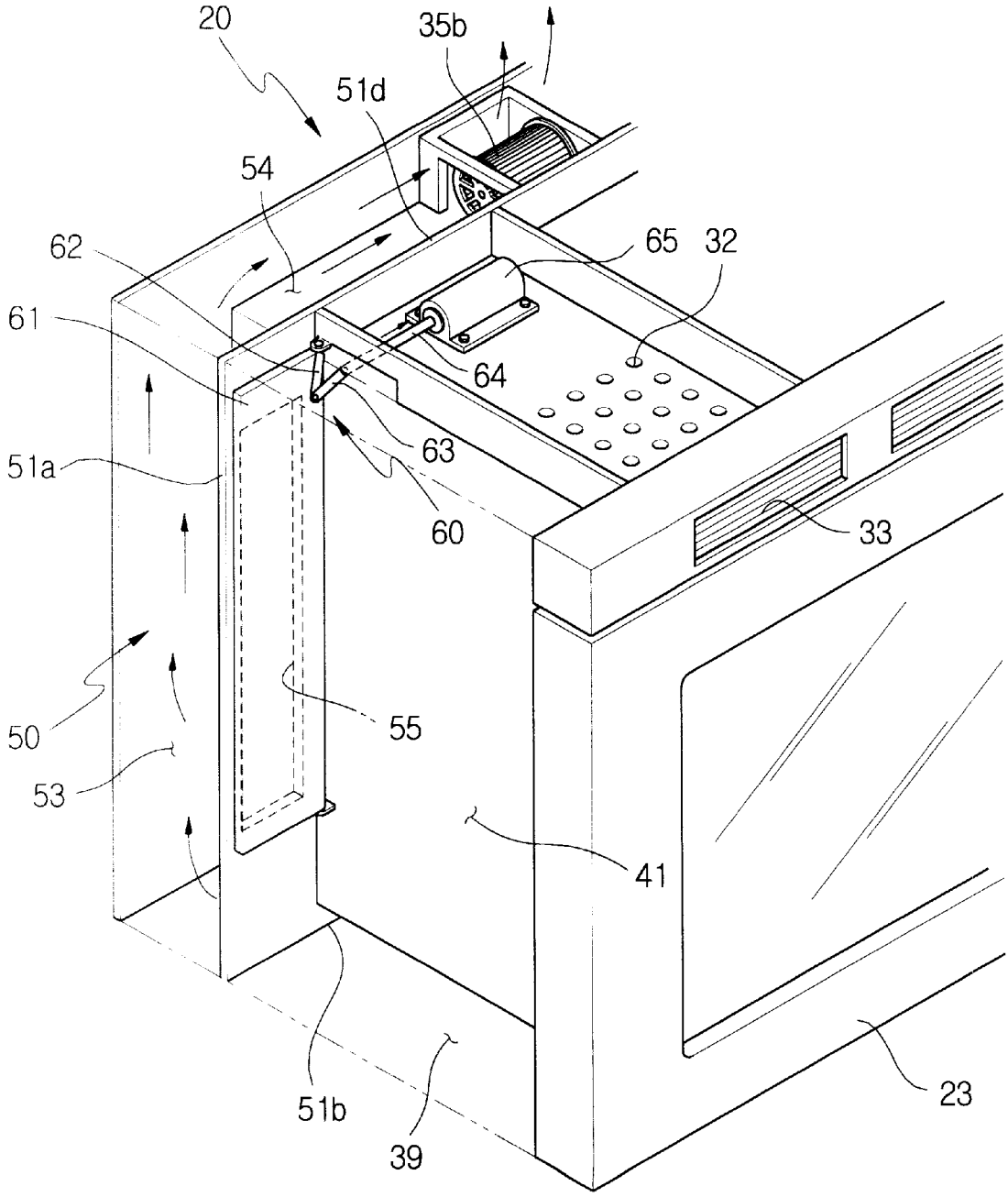
FIG. 2 is a perspective view showing a sweeping flow path of the wall-mounted type microwave oven shown in FIG. 1, in which a communicating hole provided between the sweeping flow path and an exhaust flow path is closed.

FIGS. 1 and 2 show a wall-mounted type microwave oven according to an embodiment of the present invention. The microwave oven includes an oven body 20 having a cooking chamber 21 for receiving food to be cooked therein and an electrical component compartment 22, in which various electrical components are mounted, which are isolated from each other.

The cooking chamber 21 is provided at its front with a door 23, which is hingedly coupled thereto to be opened and closed. The electrical component compartment 22 is isolated from the cooking chamber 21 by a partition plate 24. The electrical component compartment 22 is provided therein with the electrical components, including a magnetron 25 which supplies high-frequency electromagnetic waves into the cooking chamber 21, a high voltage transformer 26 which applies a high voltage to the magnetron 25, and a cooling fan 27 which cools the electrical component compartment 22. The magnetron 25 is mounted on an upper portion of a wall defining the electrical component compartment 22, and the high voltage transformer 26 is mounted on a bottom surface of the electrical component compartment 22. A waveguide 28 is disposed on the tops of the cooking chamber 21 and the electric component compartment 22 to guide the high frequency electromagnetic waves supplied from the magnetron 25 into the cooking chamber 21. The electrical component compartment 22 is provided at its front face with a control panel 29 which includes a plurality of buttons which control various functions of the microwave oven and a display which displays operational conditions of the microwave oven.

A ventilation flow path of the microwave oven allows outside air to be introduced into the electrical component compartment 22 and the cooking chamber 21, and then be discharged to the outside, for example, a kitchen room space, to ventilate the electrical component compartment 22 and the cooking chamber 21. The ventilation flow path includes a front air inlet 30 which is disposed over the control panel 29 of the oven body 20 and communicates with the electrical component compartment 22, to allow the outside air to be introduced into the electrical component compartment 22 therethrough, and a plurality of vent holes 31 which are formed at the partition plate 24 and allow the air introduced into the electrical component compartment 22 through the front air inlet 30 to be introduced into the cooking chamber 21 while cooling the electrical component compartment 22. The ventilation flow path further includes a plurality of vent holes 32 formed at an upper surface of the cooking chamber 21 and a front air outlet 33 disposed at an upper portion of a front face of the cooking chamber 21, which allow the air in the cooking chamber 21 to be discharged to the kitchen room space therethrough.

Through the ventilation flow path, in response to an operation of the cooking fan 27, outside air is introduced into the electrical component compartment 22 through the front air inlet 30 to cool the electrical component compartment 22, and then introduced into the cooking chamber 21 through the vent holes 31 of the partition plate 24 to ventilate the cooking chamber 21. Subsequently, the air in the cooking chamber 21 is discharged to the kitchen room space through the vent holes 32 and the front air outlet 33.

An exhaust flow path of the microwave oven, which is constructed to be isolated from the cooking chamber 21 and the electrical component compartment 22, allows gas and fumes generated from an oven range (not shown) disposed below the oven body 20 to be exhausted to the outside. That is, the oven body 20 is provided at its upper and rear portion with an exhaust fan assembly 35 which discharges the gas and fumes, introduced into the exhaust flow path, to the outside of the kitchen room space.

The exhaust flow path comprises intake ports 37 formed at a bottom panel 36 of the oven body 20, a lower path section 39 defined between bottom plates 38 of the cooking chamber 21 and the electrical component compartment 22 and a bottom panel 36 of the oven body 20, a first rising path section 40 vertically disposed behind the electrical component compartment 22 to communicate with the lower path section 39, and a second rising path section 41 vertically disposed on a side wall of the cooking chamber 21 to communicate with the lower path section 39 (see FIG. 2).

As shown in FIG. 1, the exhaust fan assembly 35 comprises a first exhaust fan 35*a* which exhausts air introduced into the first rising path section 40, a second exhaust fan 35*b* which exhausts air introduced into a sweeping flow path 50 (see FIG. 2), and a motor 35*c* which rotates the first and second exhaust fans 35*a* and 35*b* concurrently. The oven body 20 is further provided, above and behind the electric component compartment 22 with an upper path section 43 to allow the first rising path section 40 to communicate with the first exhaust fan 35*a*.

Figure 3:
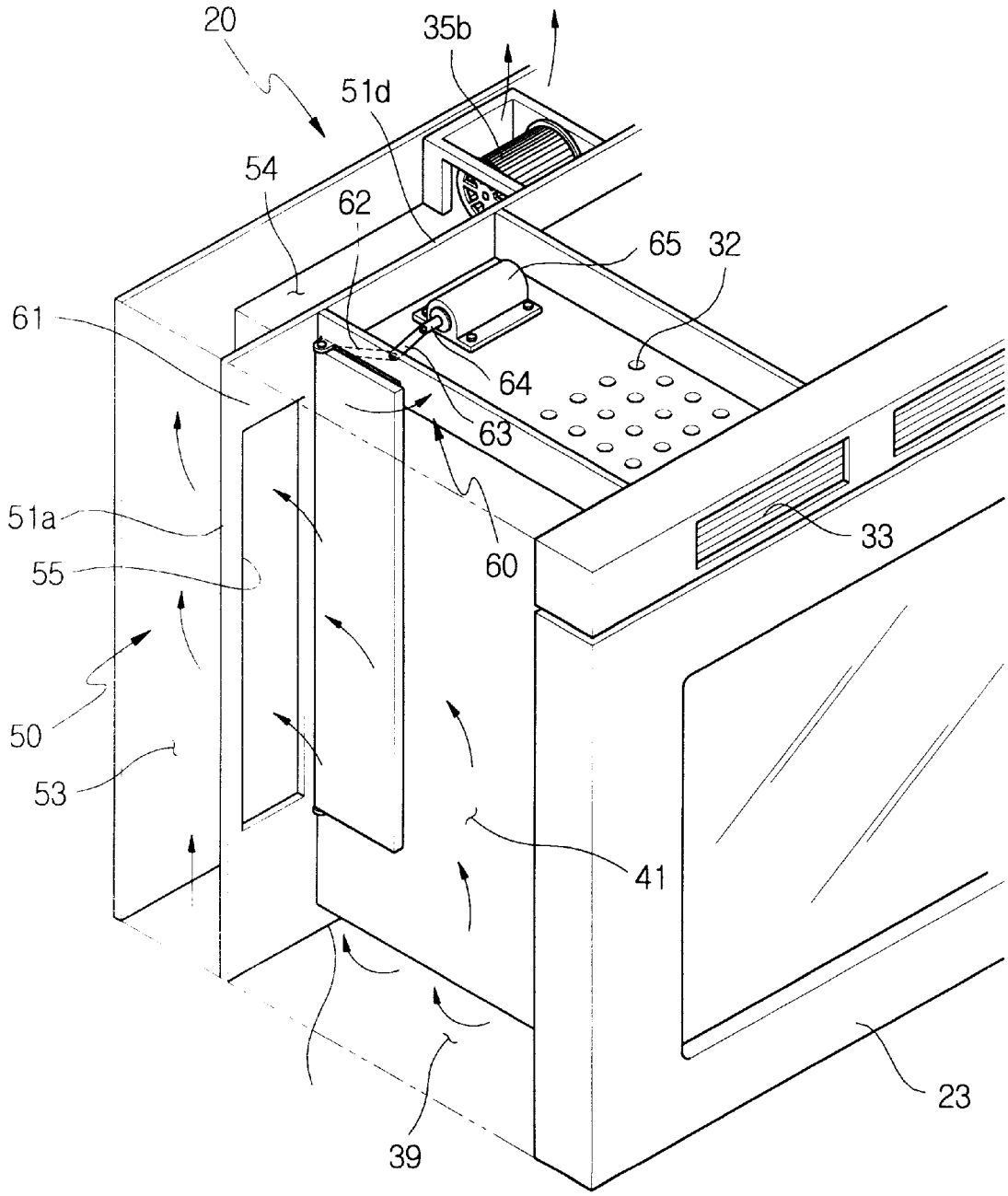
FIG. 3 is a view similar to FIG. 2, in which the communicating hole provided between the sweeping flow path and the exhaust flow path is open.
Figure 4:
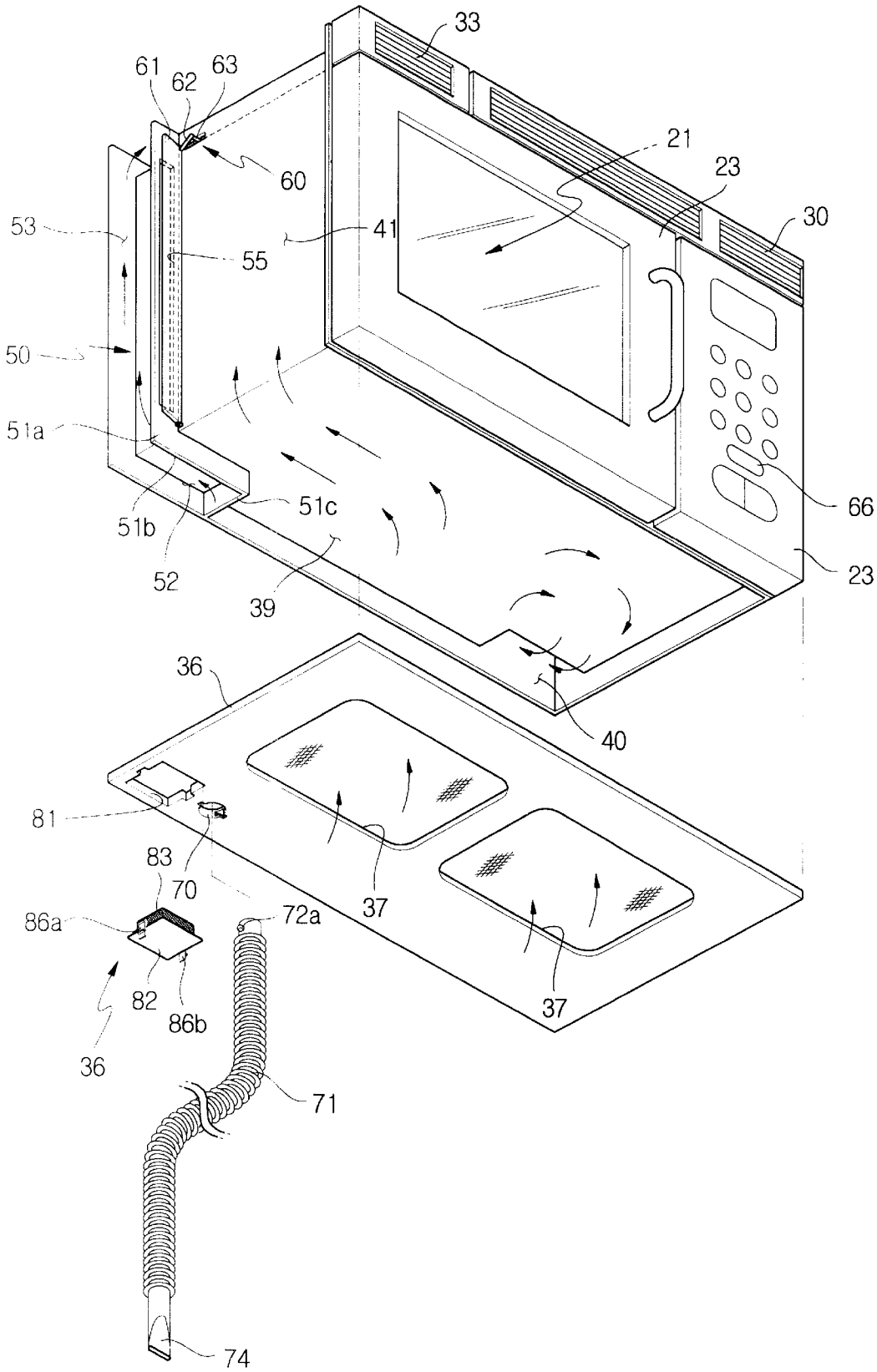
FIG. 4 is an exploded perspective view of a lower part of the wall-mounted type microwave oven shown in FIG. 1.

FIGS. 2 through 4 show the sweeping flow path 50 of the microwave oven shown in FIG. 1. As shown from these drawings, the sweeping flow path 50 is defined between a plurality of guide plates 51*a*, 51*b*, 51*c* and 51*d* and a rear panel of the oven body 20. The sweeping flow path 50 is disposed at a rear portion of a side wall of the cooking chamber 21, so as to be isolated from the second rising path section 41 of the exhaust flow path. More specifically, the sweeping flow path 50 comprises a lower sweeping path section 52 which is isolated from the lower path section 39 of the exhaust flow path, a side sweeping path section 53 which is isolated from the second rising path section 41 and disposed vertically, and an upper sweeping path section 54 which is disposed on a rear portion of the top plate of the cooking chamber 21 and allows the side sweeping path section 53 to communicate with a suction opening of the second exhaust fan 35*b*.

The guide plate 51*a*, which is adapted to isolate the second rising path section 41 from the side sweeping path section 53, is formed with a communicating hole 55 which allows air introduced into the second rising path section 41 to flow into the sweeping flow path 50. The guide plate 51*a* is further provided with an opening-closing system 60 which closes the communicating hole 55 in response to a sweeping operation and opens the communicating hole 55 in response to an exhausting operation.

The opening-closing system 60 comprises an opening-closing plate 61 hingedly coupled to a sidewall adjacent to the guide plate 51*a* to open and close the communicating hole 55, a rotating link 62 which is connected to a rotating shaft of the opening-closing plate 61 and extends by a certain length, a connecting link 63 connected to an end of the rotating link 62, and a solenoid-driven device 65 which includes an actuating rod 64 connected to the connecting link 63 and linearly drives, for example, the rotating link 62 to open/close the communicating hole 55. That is, as the actuating rod 64 is linearly moved back and forth by the solenoid-driven device 65, the rotating link 62 is rotated to open or close the opening-closing plate 61. The solenoid-driven device 65 is mounted on a top panel of the cooking chamber 21. The control panel 29 of the oven body 20 is provided with a path-converting switch 66 which activates the solenoid-driven device 65 to open or close the communicating hole 55.

Figure 5:
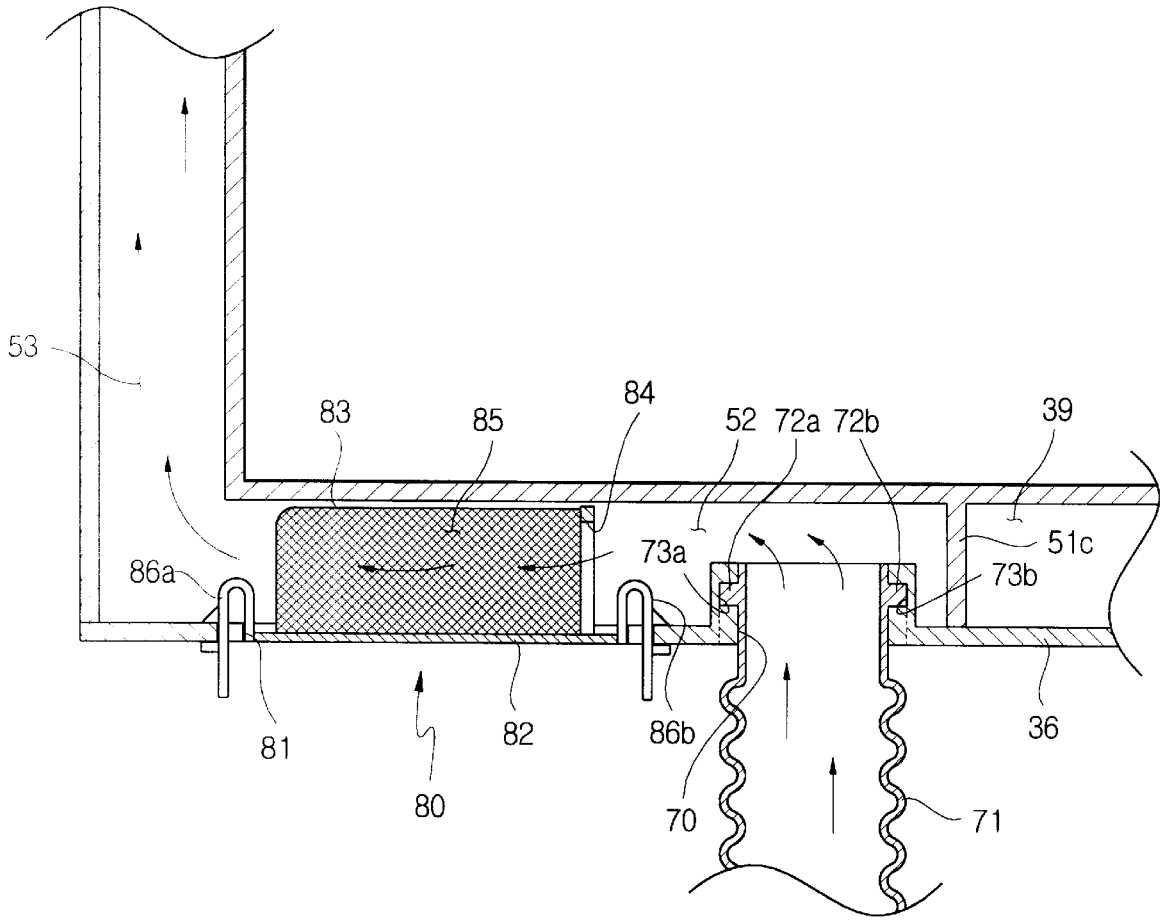
FIG. 5 is a cross-sectional view showing a sweeping hose and a filter assembly of the wall-mounted type microwave oven shown in FIG. 1.
Figure 6:
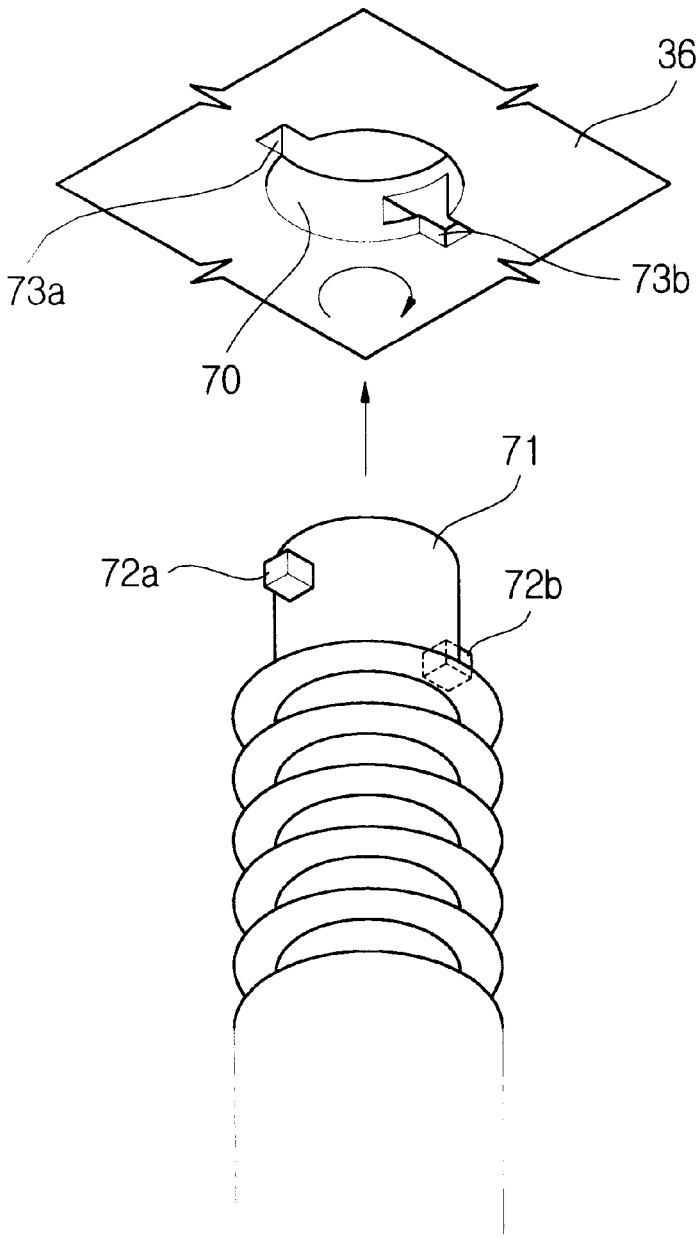
FIG. 6 is a perspective view showing a coupling structure of the sweeping hose of the wall-mounted type microwave oven shown in FIG. 1.

FIG. 5 shows a cross-sectional view of a sweeping hose 71 and a filter assembly 80 of the microwave oven shown in FIG. 1. FIG. 6 shows a coupling structure of the sweeping hose 71.

As shown in FIGS. 4 and 5, the bottom panel 36 of the oven body 10 covers a lower sweeping path section 52 and includes a sweeping inlet 70 which allows the inside of the lower sweeping flow path section 52 to communicate with the outside of the sweeping flow path 50. The sweeping hose 71 is detachably connected to the sweeping inlet 70. The bottom panel 36 of the oven body 10 is detachably provided thereon with the filter assembly 80 which is disposed in a portion of the lower sweeping path section 52 downstream of the sweeping inlet 70, so as to filter out foreign substances contained in air introduced through the sweeping inlet 70. The sweeping hose 71 can be made of a flexible material and be outwardly extendable so as to reach and collect debris and dirt from an upper surface of an oven range (not shown) and areas adjacent thereto.

As shown in FIGS. 5 and 6, the sweeping hose 71 is externally provided with locking protrusions 72*a* and 72*b* at its upper end so as to have the sweeping hose 71 be detachably fitted into the sweeping inlet 70. The sweeping inlet 70 is provided at its inner surface with corresponding locking recesses 73*a* and 73*b* into which the locking protrusions 72*a* and 72*b* of the sweeping hose 71 are fitted. Each of the locking recesses 73*a* and 73*b* comprises an angled recess which is extended upwardly from a lower surface of the bottom panel 36 and then extended laterally, so as to have the sweeping hose 71 be locked into the sweeping inlet 70 by being inserted into the sweeping inlet 70 and then rotated.

Referring back to FIGS. 4 and 5, the filter assembly 80 comprises a cover plate 82 which is detachably fitted into a filter opening 81 formed at a position of the bottom panel 36 corresponding to the lower sweeping path section 52, and a filter unit 83 which is attached to an inner surface of the cover plate 82 and filters out foreign substances contained in air introduced into the lower sweeping path section 52. The filter unit 83 is provided at its end facing the sweeping inlet 70 with an opening 84 having a sectional area corresponding that of the lower sweeping path section 52, and is provided therein with a filtering space 85 to collect the foreign substances therein. The cover plate 82 is provided at both its sides with, for example, snap hooks 86*a* and 86*b* which elastically deform and allow the cover plate 82 to be detachably fitted into the filter opening 81. Accordingly, the filter assembly 80 can be separated from the oven body 20 to allow the foreign substances accumulated thereto to be removed by a user where a predetermined amount of foreign substances is accumulated thereto.

With references to FIGS. 1–6, an operation of the wall-mounted type microwave oven according to the present invention will be described in detail below.

To exhaust gas and fumes generated from an oven range (not shown) disposed below the oven body 20, an exhaust button of the control panel 29 can be pushed by a user to activate the exhaust fan assembly 35. At this point, the opening-closing system 60 is activated in response to the path-converting switch 66 being pushed, so as to open the opening-closing plate 61, as shown in FIG. 3. Therefore, gas and fumes generated from the oven range positioned below the oven body 20 are exhausted through both of the flow paths provided in the oven body 20.

More specifically, air, containing gas and fumes positioned under the oven body 20, is introduced into the lower exhaust path section 39 through the intake ports 37 formed at the bottom panel 36 of the oven body 20. A portion of the air introduced into the lower path section 39 is directed to the first exhaust fan 35*a* through the first rising path 40 disposed behind the electrical component compartment 22 and then discharged to the outside (see FIG. 1). At the same time, since the communicating hole 55 is opened to allow the sweeping flow path 50 to communicate with the second rising path section 41, the remaining portion of the air introduced into the lower path section 39 is directed to the second exhaust fan 35*b* through the second rising path section 41, the communicating hole 55 and sweeping path sections 53 and 54, and then discharged to the outside (see FIG. 3). At this point, the sweeping inlet 70 may also be opened, and air under the oven body 20 can be further sucked through the sweeping inlet 70 to be discharged to the outside, thereby further improving the exhausting capability of the microwave oven.

On the other hand, to clean, for example, an upper surface of the oven range and areas adjacent thereto, the sweeping hose 71 can be connected to the sweeping inlet 70 of the oven body 20 where the exhaust fan assembly 35 is activated. At this point, the opening-closing system 60 is operated by the path-converting switch 66 on the control panel 29, so as to close the communicating hole 55 and prevent a communication between the sweeping path section 53 and the second rising path section 41, as shown in FIG. 2. Therefore, the microwave oven can carry out a sweeping operation using the second exhaust fan 35*b*, while carrying out an exhausting operation for gas and fumes existing under the oven body 20 using the first exhaust fan 35*a*.

That is, since a suction force of the first exhaust fan 35*a* still acts on the first rising path section 40, the gas and fumes existing under the oven body 20 are sucked into the first exhaust fan 35*a* through the lower path section 39 and the first rising path section 40, and are discharged to the outside. In addition, since the communicating hole 55 is closed, a suction force of the second exhaust fan 35*b* acts on the sweeping inlet 70. Therefore, a user can clean the top surface of the oven range and the areas adjacent thereto by using the suction force acting on a nozzle provided at a free end of the sweeping hose 71. The foreign substances contained in air introduced through the sweeping hose 71 are filtered out by the filter unit 83 of the filter assembly 80, and air, which has passed through the filter unit 83, is directed to the second exhaust fan 35*b* and discharged to the outside. After completing the sweeping (cleaning) operation, the sweeping hose 71 can be separated from the sweeping inlet 71 and stored in a separate storing place. The filter assembly 80 can be separated from the oven body 20 to allow the foreign substances in the filter unit 83 to be removed and allow the filter unit 83 to be cleaned.

As described above, the present invention provides a wall-mounted type microwave oven which is adapted to carry out a cleaning operation of a top surface of an oven range disposed therebelow and areas adjacent thereto, in addition to carrying out cooking and exhausting operations.

The microwave oven of the present invention enables a flow path to be switched between a sweeping flow path and an exhaust flow path through a system which opens and closes a communicating hole provided between the two flow paths. Accordingly, it is possible to exhaust air existing under the oven using first and second exhaust fans of the microwave oven. It is also possible to sweep/clean the oven range by employing a sweeping hose with a suction force of the second exhaust fan while exhausting the air existing under the oven using the first exhaust fan. Therefore, the microwave oven of the present invention can carry out a sweeping/cleaning operation, as well as the cooking and exhausting operations.

The sweeping hose can be stored in a separate compartment after completing the sweeping/cleaning operation. The microwave oven is also detachably provided with a filter assembly to filter debris collected during the sweeping/cleaning operation.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A wall-mounted type microwave oven comprising:

an oven body to mount in a cooking area and includes a cooking chamber and an electrical component compartment which are isolated from each other;

an exhaust flow path which communicates between an intake port provided at a bottom panel of the oven body and an exhaust outlet provided at a top panel of the oven body to exhaust air, existing under the oven body, to the outside of the cooking area;

an exhaust fan assembly provided at the exhaust outlet;

a sweeping inlet provided at the bottom panel of the oven body;

a sweeping flow path which is disposed in the oven body, and communicates with an inlet of the exhaust fan assembly and the sweeping inlet;

a filter assembly disposed in the sweeping flow path; and a sweeping hose detachably coupled to the sweeping inlet.

2. The microwave oven as set forth in claim 1, wherein the sweeping flow path is defined by a plurality of guide plates positioned at upper, side and lower portions of the oven body which isolate the sweeping flow path from the exhaust flow path.

3. The microwave oven as set forth in claim 2, wherein:

one of the guide plates includes a communicating hole which allows the exhaust flow path to communicate with the sweeping flow path, and the oven body further includes an opening-closing unit which selectively opens and closes the communicating hole.

4. The microwave oven as set forth in claim 3, wherein the opening-closing unit comprises:

an opening-closing plate rotatably provided adjacent to the communicating hole;

a rotating link which is connected to a rotating shaft of the opening-closing plate and has a predetermined length; and a solenoid-driven device which includes an actuating rod connected to an end of the rotating link and linearly drives the rotating link to open/close the communicating hole.

5. The microwave oven as set forth in claim 3, further comprising a control panel having a path-converting switch which controls the opening-closing unit to open/close the communicating hole.

6. The microwave oven as set forth in claim 1, wherein the filter assembly comprises:

a cover plate which is detachably fitted into a filter opening formed at a position of the bottom panel corresponding to the sweeping flow path; and a filter unit which is attached to an inner surface of the cover plate, has a sectional area corresponding to that of the sweeping flow path, and filters out foreign substances contained in air introduced into the sweeping flow path.

7. The microwave oven as set forth in claim 6, wherein the cover plate includes snap hooks which are provided at corresponding sides of the cover plate and elastically deform to allow the cover plate to be detachably fitted into the filter opening.

8. The microwave oven as set forth in claim 1, wherein:

the sweeping inlet includes a locking recess, and the sweeping hose includes a locking protrusion which is provided at a coupling end of the sweeping hose and engages with the locking recess to secure the sweeping hose to the sweeping inlet.

9. The microwave oven as set forth in claim 1, wherein the exhaust fan assembly comprises:

a first exhaust fan which exhausts air introduced into the exhaust flow path;

a second exhaust fan which exhausts air introduced into the sweeping flow path; and a motor which rotates the first and second exhaust fans concurrently.

10. The microwave oven as set forth in claim 1, wherein the exhaust flow path comprises:

a lower path section which is disposed at the bottoms of the cooking chamber and the electrical component compartment and includes the intake port;

a first rising path section which is vertically disposed behind the electric component compartment and communicates with the lower path section; and a second rising path section which is vertically disposed on a side wall of the cooking chamber and communicates with the lower path section.

11. The microwave oven as set forth in claim 1, further comprising:

a magnetron which generates microwave to cook food contained in the cooking chamber;

a high voltage transformer which drives the magnetron; and a cooling fan which cools the electrical component compartment.

12. The microwave oven as set forth in claim 1, further comprising a ventilation flow path which ventilates air introduced into the electrical component compartment and the cooking chamber to the cooking area.

13. The microwave oven as set forth in claim 1, wherein:

the exhaust flow path comprises:

a lower path section disposed at a lower portion of the oven body;

a first rising path section which is disposed at a vertical side portion of the oven body and communicates with the lower path section; and a second rising path section which is disposed at another vertical side portion of the oven body and communicates with the lower path section, and the sweeping flow path comprises:

a communicating hole which allows the second rising flow path to communicate with the sweeping flow path; and an opening-closing unit which selectively opens and closes the communicating hole.

14. The microwave oven as set forth in claim 13, further comprising a control panel having a path-converting switch which controls the opening-closing unit.

15. The microwave oven as set forth in claim 14, wherein the exhaust fan assembly comprises:

a first exhaust fan which exhausts air introduced into the first rising path section;

a second exhaust fan which exhausts air introduced into the sweeping flow path in response to the communicating hole being closed, and exhausts air introduced into the sweeping flow path and the second rising path section in response to the communicating hole being open; and a motor which rotates the first and second exhaust fans.

16. The microwave oven as set forth in claim 15, further comprising a sweeping inlet cover which is detachably provided to the sweeping inlet so as to prevent air from being introduced into the sweeping flow path, and have the second exhaust fan exhaust the air introduced into the second rising path section in response to the communicating hole being open.

17. A wall-mountable cooking apparatus comprising:

an oven body to mount in a cooking area and includes a cooking chamber and an electrical component compartment which are isolated from each other;

a heating unit to cook food contained in the cooking chamber;

an exhaust flow path which communicates between a lower portion of the oven body and an upper exhaust outlet of the oven body to exhaust air, existing under the oven body, to the outside of the cooking area;

an exhaust fan assembly provided at the upper exhaust outlet;

a sweeping inlet provided at the lower portion of the oven body;

a sweeping flow path which communicates between the exhaust fan assembly and the sweeping inlet; and a sweeping hose detachably coupled to the sweeping inlet.

18. The cooking apparatus as set forth in claim 17, wherein the sweeping flow path includes:

a filter assembly which collects debris contained in air introduced into the sweeping inlet;

a communicating hole which allows the exhaust flow path to communicate with the sweeping flow path, so as to exhaust a portion of the air existing under the oven body to the outside of the cooking area through the sweeping flow path; and an opening-closing unit which selectively opens/closes the communicating hole.

19. The cooking apparatus as set forth in claim 18, further comprising a control panel having a path-converting switch which controls the opening-closing unit.

20. The cooking apparatus as set forth in claim 19, wherein the exhaust fan assembly comprises:

a first exhaust fan which exhausts air introduced into a first rising path of the exhaust flow path;

a second exhaust fan which exhausts air introduced into the sweeping flow path in response to the communicating hole being closed, and exhausts air introduced into the sweeping flow path and a second rising path of the exhaust flow path in response to the communicating hole being open; and a motor which rotates the first and second exhaust fans.

* * * * *